US005915394A

United States Patent [19]

Rickard

[11] Patent Number: 5,915,394

[45] Date of Patent: Jun. 29, 1999

[54] FRAGRANCE TOWELETTE

[76] Inventor: Peter Rickard, 12400 Montecito Rd., #216, Seal Beach, Calif. 90740

[21] Appl. No.: 09/132,098

[22] Filed: Aug. 10, 1998

[51] Int. Cl.[6] ..... A45D 44/00

[52] U.S. Cl. ..... 132/333; 206/812

[58] Field of Search ..... 132/317, 333; 206/494, 812, 823

[56] References Cited

U.S. PATENT DOCUMENTS

| | | | |
|---|---|---|---|
| 2,999,265 | 9/1961 | Duane et al. | 206/812 |
| 3,129,811 | 4/1964 | Williams | 206/812 |
| 3,150,049 | 9/1964 | Emory | 206/812 |
| 3,398,826 | 8/1968 | Clancy | 206/812 |
| 5,487,932 | 1/1996 | Dunshee | 206/812 |
| 5,566,693 | 10/1996 | Gunderman et al. | 132/333 |
| 5,568,866 | 10/1996 | Grosskopf et al. | 206/823 |
| 5,645,161 | 7/1997 | Whitaker et al. | 206/812 |

FOREIGN PATENT DOCUMENTS

| | | | |
|---|---|---|---|
| 94/05182 | 3/1994 | WIPO | 132/333 |

*Primary Examiner*—Todd E. Manahan
*Attorney, Agent, or Firm*—Goldstein & Canino

[57] ABSTRACT

A fragranced towelette, comprising a package, defining an internal cavity, and a napkin that is located within the cavity. The napkin is impregnated with a fragranced composition, and is folded into a compact form before being sealed within the package. Just prior to use, the napkin is removed from the package and is unfolded flat. The napkin is then rubbed upon the skin to impart the fragranced composition thereupon.

1 Claim, 2 Drawing Sheets

FRAGRANCE TOWELETTE

BACKGROUND OF THE INVENTION

The invention relates to a fragranced towelette. More particularly, the invention relates to a towelette which contains a fragrance, and is packaged within a packet, and is removed therefrom just prior to use.

A great majority of the population uses perfumes and colognes on a daily basis. Research has shown that people tend to act favorably toward people who emanate a pleasant fragrance. Thus many people apply perfume and cologne in the morning before work, and before social outings.

The problem with fragrances is that they quickly fade in time. That is, they tend to be strong when first applied, and then quickly dissipate as they evaporate from the skin. After exercising, dancing and working, the fragrance is quickly diluted and overcome by bodily secretions.

While these units may be suitable for the particular purpose employed, or for general use, they would not be as suitable for the purposes of the present invention as disclosed hereafter.

SUMMARY OF THE INVENTION

It is an object of the invention to produce a fragranced towelette which is conveniently available to impart a fragrance. Accordingly, the towelette is enclosed in a sealed packet, which is opened just prior to use.

It is another object of the invention to provide a fragranced towelette which provides a pleasant fragrance. Accordingly, the towelette is impregnated with commonly available, recognizable brand name fragrances.

It is a further object of the invention to provide a fragranced towelette that allows the fragrance to be evenly imparted onto a large surface area. Accordingly, the towelette has multiple folds so that it may be unfolded into a large surface area towelette.

The invention is a fragranced towelette, comprising a package, defining an internal cavity, and a napkin that is located within the cavity. The napkin is impregnated with a fragranced composition, and is folded into a compact form before being sealed within the package. Just prior to use, the napkin is removed from the package and is unfolded flat. The napkin is then rubbed upon the skin to impart the fragranced composition thereupon.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
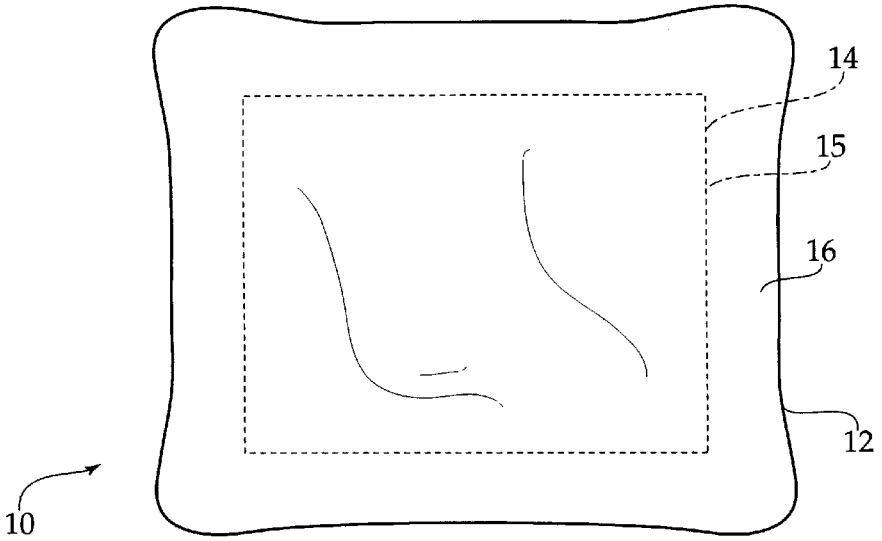
FIG. 1 is a top plan view, illustrating the towelette, contained within the package.

FIG. 1 illustrates a fragranced towelette 10. The fragranced towelette 10 comprises a package 12, which contains a napkin 14. The package 12 has an internal cavity 15 wherein the napkin 14 is located. The internal cavity 15 has a pair of outer edges 16 which are sealed to isolate the internal cavity 15 from the environment surrounding the package 12. The napkin 14 is impregnated with a fragranced composition. Preferably, the fragranced composition is an isopropyl alcohol based cologne or perfume.

Figure 2:
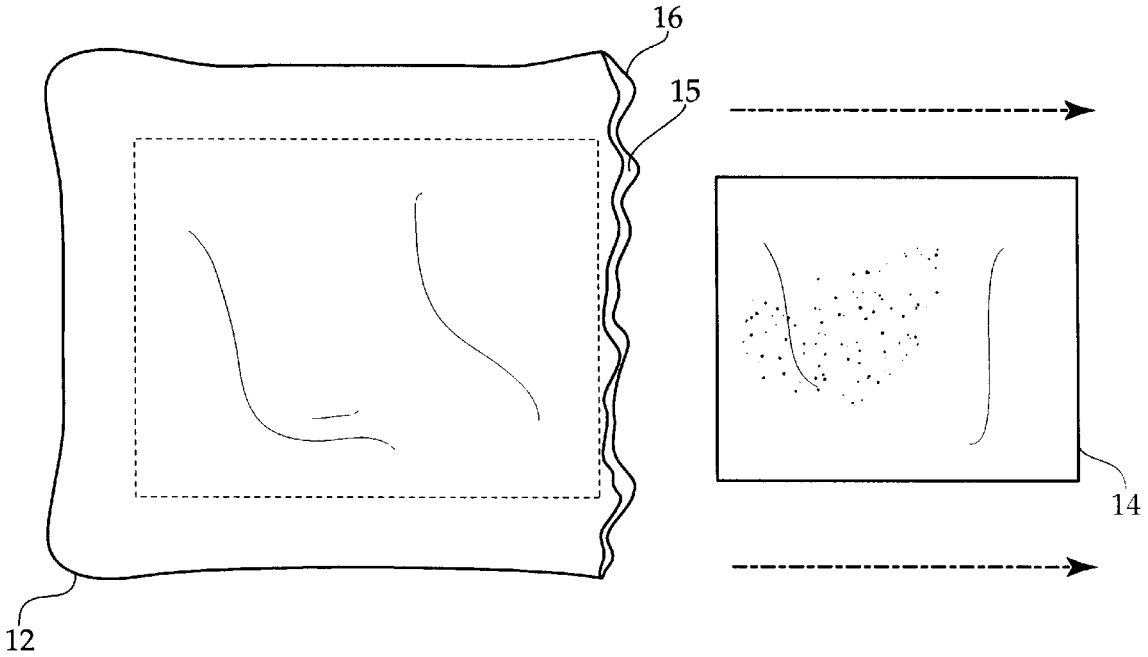
FIG. 2 is a top plan view, illustrating the towelette being removed from the package.

FIG. 2 illustrates the fragranced towelette 10, wherein an outer edge 16 has been ripped from the package 12 to provide access to the internal cavity 15. The napkin 14 is then removed from the package 12. The napkin 14 is folded when it is removed from the package for the sake of compactness and convenience.

Figure 3:
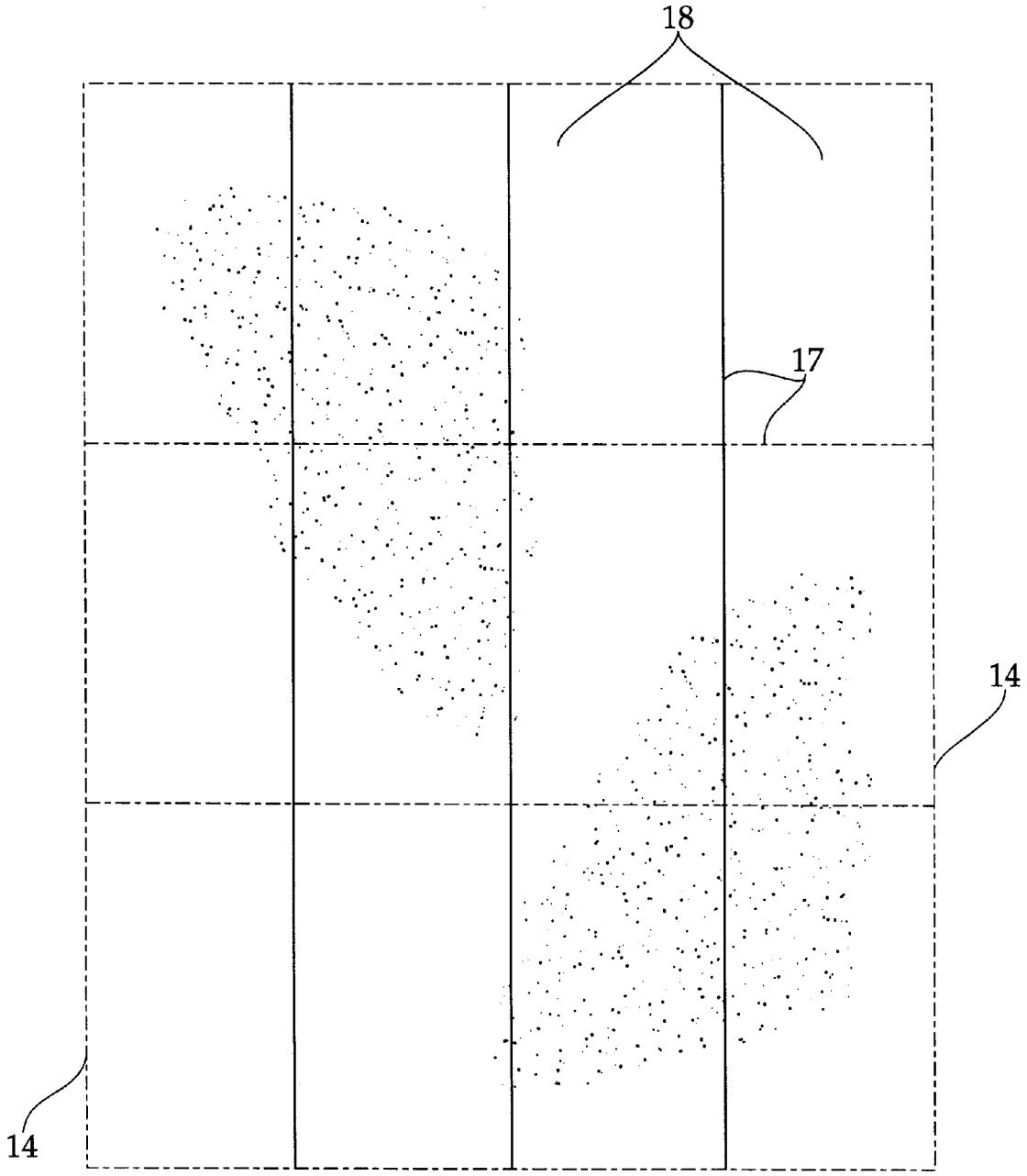
FIG. 3 is a top plan view, illustrating the towelette fully removed from the package and fully unfolded.

FIG. 3 illustrates the napkin 14, wherein said napkin has been fully unfolded. The napkin 14 is illustrated laid flat, measuring approximately four by five inches, and comprises a plurality of fold lines 17, which delineate the folding of the napkin 14 into the compact form illustrated in FIG. 2. The fold lines 17 define twelve regions 18, which each measure approximately one inch by one point seven inches. This size allows the package to be approximately 1½ by 2 inches, a convenient size for storage. Therefore, the napkin 14 is initially folded when contained within the package 12, but is unfolded once it is removed from the package 12, just prior to use.

Once the napkin 14 has been removed from the package 12 and has been completely unfolded, it may be wiped on the skin to impart the impregnated fragrance composition onto the user. The relatively large surface area of the napkin compared to common facial swabs or pads allows the fragrance composition to be evenly distributed upon the skin of the user.

In conclusion, herein is presented a fragranced towelette which is initially contained in a folded state within a package, is removed from the package and unfolded just prior to use, and then is wiped upon the skin to impact a fragranced composition thereupon.

What is claimed is:

1. A fragranced towelette, comprising:

a napkin, having a plurality of folds so that it may selectively enter a compact folded position, or may be completely unfolded into a flat position, wherein the folds define twelve rectangular regions, and wherein the napkin is substantially five inches by four inches when fully unfolded;

a package, defining an internal cavity which is sized for containing the napkin when said napkin is in its compact folded position; and a fragranced composition that is impregnated within the napkin.

* * * * *